United States Patent [19]

Kübler

[11] 4,264,806

[45] Apr. 28, 1981

[54] ELECTROMECHANICAL PULSE COUNTER

[75] Inventor: Fritz Kübler, Villingen-Schwenningen, Fed. Rep. of Germany

[73] Assignee: Ing. Fritz Kübler Zählerfabrik, Schwenningen, Fed. Rep. of Germany

[21] Appl. No.: 20,934

[22] Filed: Mar. 15, 1979

[30] Foreign Application Priority Data

Mar. 15, 1978 [DE] Fed. Rep. of Germany ..... 2811173

[51] Int. Cl.[3] ..... G06M 1/10; G06M 1/30

[52] U.S. Cl. ..... 235/92 C; 235/144 HC

[58] Field of Search ..... 235/92 C, 92 R, 144 HC, 235/144 DM, 144 SM

[56] References Cited

U.S. PATENT DOCUMENTS

| | | | |
|---|---|---|---|
| 3,648,028 | 3/1972 | Hara et al. | 235/92 C |
| 3,845,899 | 11/1974 | Irie et al. | 235/92 C |
| 3,916,164 | 10/1975 | Kundisch et al. | 235/92 C |
| 4,012,624 | 3/1977 | Haller et al. | 235/92 C |

*Primary Examiner*—Joseph M. Thesz

*Attorney, Agent, or Firm*—Becker & Becker, Inc.

[57] ABSTRACT

Electromechanical pulse counter with a housing, wherein a current carrying spool and coil means is secured, whereby the spool and coil means surround an iron core, an air gap defined between the iron core and an armature anchor, preferably in the form of a plate-like armature anchor, responsive to the magnetic field of the spool and coil means. The armature anchor is movably mounted in the housing, and actuates an escapement anchor, having a control fork which, stepwise, by the intervention of a gear drive, rotates at least one indicator wheel having indicator numbers on its circumference. The iron core is positively held at the housing part which comprises a support for the armature anchor, and the iron core is journalled so as to be movable with respect to the spool and coil means.

18 Claims, 9 Drawing Figures

1
4
5
6
7
9
10
11
12
13
14
15
16
17
18
19
20
21
22
23
24
25
26
27
28
69
79
80
IV

ELECTROMECHANICAL PULSE COUNTER

The present invention relates to an electromechanical pulse counter with a housing, wherein the current carrying spool and coil means is secured, whereby said spool and coil means surround an iron core. The iron core and an armature, preferably a plate-like armature anchor, are spaced apart to form an air gap, said armature being responsive to the magnetic field provided by the spool and coil means. The armature is movably mounted in the housing and actuates an escapement anchor having a control fork which, stepwise, by the intervention of a gear drive means, rotates at least one indicator wheel having indicator numbers provided on its circumference.

Such pulse counters, for example, count the working cycles of machine tools. After each working cycle, current is passed through the coil and, due to the resultant magnetic field, the armature provided in the housing is attracted. The armature actuates the escapement anchor which, by the intervention of a gear drive means, rotates the indicator wheel for a further step. For accurate counting of pulses, the size of the air gap formed between the armature and the iron core is the decisive parameter. In a known electromechanical pulse counter of this type, the spool housing is normally provided by a plastic or synthetic spool housing. Due to the unavoidable temperature fluctuations, during operation, the plastic spool housing and the pertaining iron core expand and contract. Due to the differing thermal expansion coefficients of synthetic materials and iron, and due to the rigid mounting of the iron core on the spool, the size of the air gap changes on temperature fluctuations.

There exists then the danger that the pulse counter does not indicate the accurate value any longer. When the air gap is too wide, the resultant magnetic field is not sufficient to attract the armature and, thereby, to rotate the indicator wheel. When the air gap is too small, the armature may adhere at the iron core, so that pulses arriving in the intervening time are not counted. Usually, as well, the housing of said pulse counter is provided by a synthetic or plastic material housing, whereby the material expands or contracts due to temperature fluctuations. The armature movably retained at the housing is, accordingly, moved relative to the iron core, so that, again, hereby, the air gap may be changed. In order to avoid these difficulties, the air gap is adjusted, at the outset, so large that the relative movements between the armature and the iron core, due to temperature fluctuations, do not affect the counting accuracy of the pulse counter. For this, however, the spool must be designed for a higher number of ampere turns and, accordingly, a higher energy input is required in order to actuate the armature. Such pulse counters, thereby, require proportionally higher energy inputs and are often not applicable for certain applications.

It is the object of the present invention to provide an electromechanical pulse counter of the type indicated above wherein the air gap between the armature and the iron core can be adjusted to an optimally low width without adjustment or calibration.

These and other objects and advantages of the invention will appear more clearly from the following specification in connection with the accompanying drawings in which.

The pulse counter according to the present invention is characterized primarily by an iron core which is positively held at the housing component which provides retainment of the armature and which iron core is movable relative to the spool.

The armature and iron core defining between them an air gap are provided at the same housing component so that, on expansion or contraction of the housing, the distance between the armature and the iron core and, therefore, the width of the air gap, are not changed; also, deformations of the spool housing do not affect the position of the iron core since this is movable within the spool.

The pulse counter in accordance with the invention can be adjusted to the most favorable air gap width for which only a low number of ampere turns is required.

The pulse counter has only a low current consumption during operation and has a high counting accuracy due to the constant air gap width which is independent of temperature fluctuations.

Figure 1:
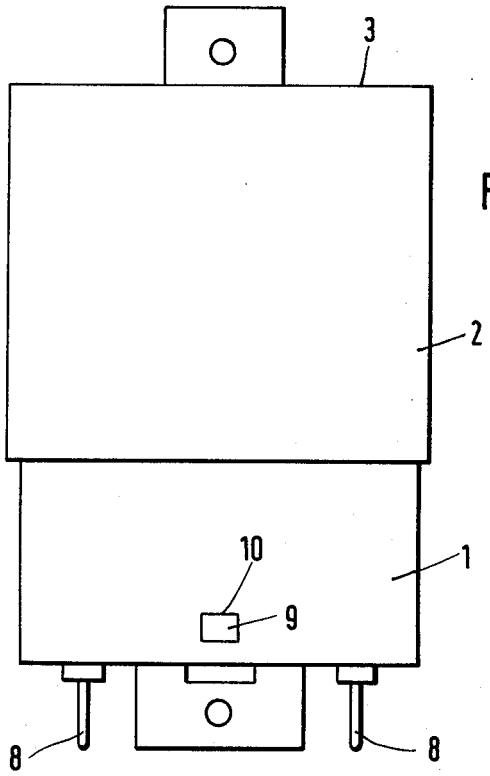
FIG. 1 is a diagrammatical representation of a front view of a pulse counter in accordance with the invention.

Referring now particularly to the drawings, the electromechanical pulse counter shown in FIG. 1 comprises a housing 1 over the upper part of which is placed a cover 2, preferably made of plastic or synthetic material. The cover 2 is removably securable on housing 1 by means of a mating detent connection, not shown. At the face side 3, housing 1 and cover 2 comprise a viewing window, not shown, through which are visible the digits of the counter arrangement.

In the lower part of housing 1 there is provided a carrier 4 which includes in its central region a raised support 5 on which a spool body 6 is positioned. The spool body 6, preferably made of plastic or synthetic material, carries coil windings 7 having two ends connected to terminals 8 and 8' (FIG. 1). The carrier 4, raised support 5, and spool body 6 are preferably formed as a unitary structure. The raised support 5 comprises detention lugs 9, provided on two oppositely positioned sides (FIG. 3), which lugs 9 extend into pertaining openings 10 in housing 1. The carrier 4 has a generally rectangular outline and forms in its assembled position (FIG. 4) the bottom of housing 1. Due to the unitary construction of carrier 4, raised support 5, and spool body 6, and due to the releasable mating connection provided by the elements 9 and 10, a simple assembly is afforded. In the assembled position indicated in FIG. 3, the raised support 5 and the spool body 6, the latter with a flange-like upper rim 11, are supported on the inner side of the housing 1. The carrier 4 and the spool body 6 are, thus, securely held in housing 1.

Figures 3, 4:
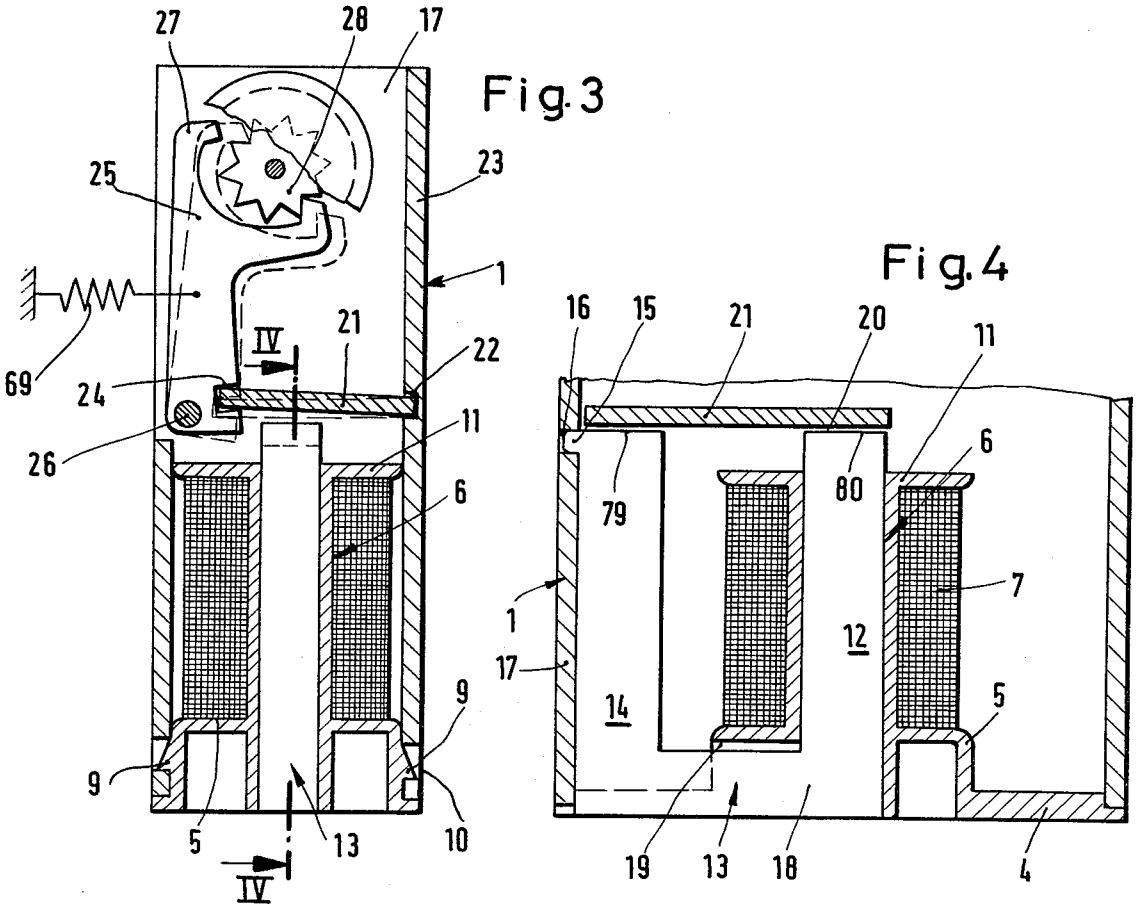
FIG. 3 is a view, drawn to a larger scale, in the direction of line III—III in FIG. 2.
FIG. 4 is a view along line IV—IV in FIG. 3.

The spool body 6 and windings 7, forming spool and coil means for the provision of a magnetic field, as will be described furtherbelow, surround the arm 12 of a U-shaped iron core 13. The other arm 14 of the iron core 13 rests against the inner wall of the housing along or beside the spool body 6 and includes at its free end a projection 15 directed oppositely to the other arm 12. The iron core 13 extends with the projection 15 into a matching, generally rectangular, opening 16 provided in housing wall 17. The position of the spool body 6 and the dimensions of the iron core 13 are selected such that the arm 14 rests on the inner wall surface of the housing 1, as indicated in FIG. 4. The base member 18 connecting the arms 12 and 14 of the iron core 13 lies securely with part of its length in a recess 19 in carrier 4 and raised support 5. Thus, the iron core 13 is accurately aligned with respect to spool body 6.

The iron core 13 is positioned adjacent an armature anchor or magnet anchor 21 for the provision of an air gap 20. The armature anchor 21 is generally rectangularly formed and movably held by one side in a recess 22 in inner wall 23 of housing 1. The opposite side of the armature anchor 21 is adapted to engage an escapement anchor 25 having a suitable receiving depression 24 (FIG. 3). The escapement anchor 25 rests on the inner surface of housing wall 17, the latter extending orthogonally to the housing wall 23, and is swingably held in this by means of an axle 26. The escapement anchor 25 engages with its control fork member 27 a gear 28 which is rotatably mounted at the inside face of wall 17. The escapement anchor, as is known, actuates, in stepwise manner, the gear 28. This gear 28 is operatively connected, by the intervention of a further gear, not shown, to gear 29 (FIG. 2) of the adjacent indicator wheel 30. Indicator wheel 30 carries on its periphery the digits 0 to 9. The indicator wheel or digit wheel 30 is provided on an axle 31 which is journalled with its ends in the oppositely disposed housing walls 17 and 32. Further indicator wheels 30 with peripheral indicator digits 0 to 9 are provided on axles 31. Each indicator wheel 30 has on the side facing the escapement anchor 25 a gear 29.

Figure 2:
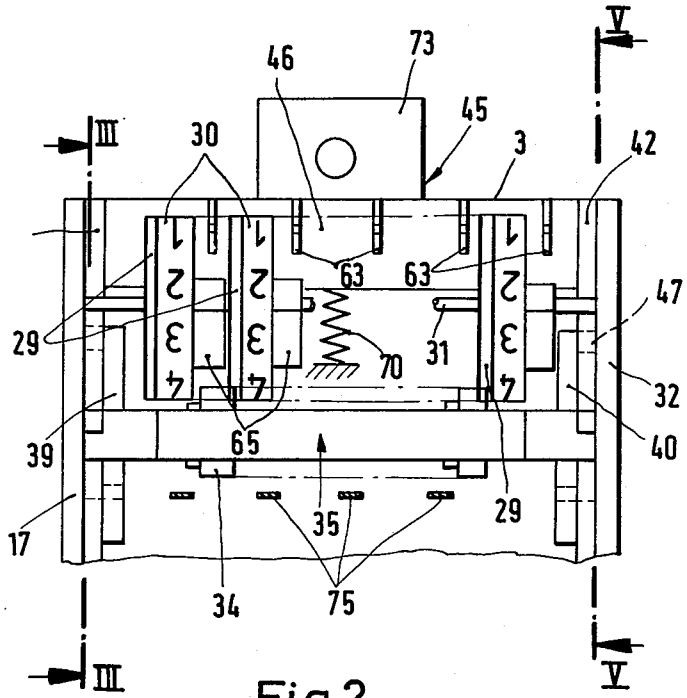
FIG. 2 shows the upper part of the pulse counter according to FIG. 1, drawn to a larger scale, with the housing cover removed.
Figure 5:
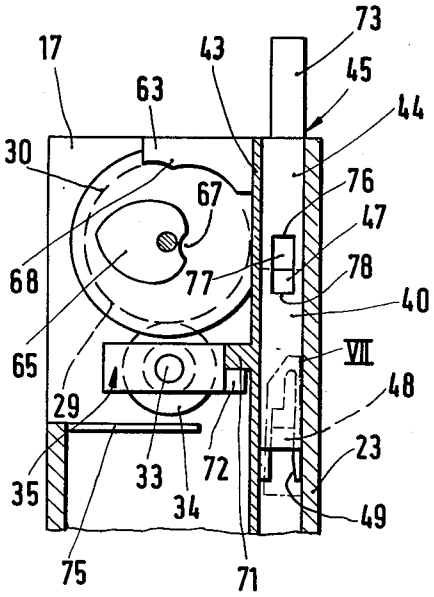
FIG. 5 is a view along line V—V in FIG. 2 of part of the reset system.
Figure 8:
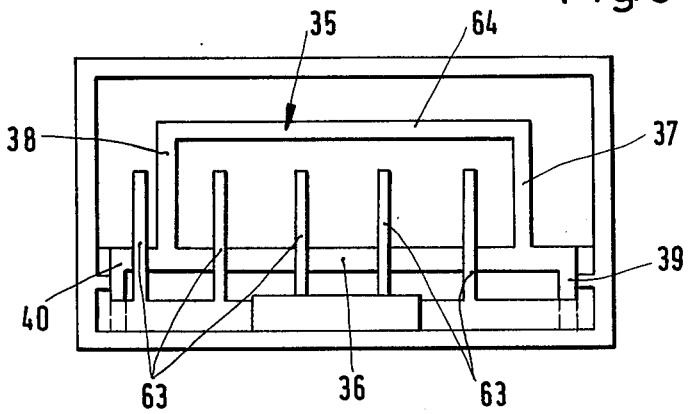
FIG. 8 is a diagrammatical representation of a plan view of the reset system of the counter in accordance with the invention, with the indicator wheels removed.

The gear, not shown, associated with gear 28 is provided on the side of the indicator wheel 30 facing away from the face side 3 of the housing 1, on a further axle 33 so as to be rotatable. (FIG. 5). Further gears 34 are freely revolvingly provided on axle 33, each of the gears 34 meshing with a pertaining gear 29 of pertaining indicator wheels 30 (FIG. 2). The axle 33 is supported by a drive frame or support frame system 35, which surrounds the gears 34. The drive frame or support frame system 35 is shown in FIG. 8, but without the axle 33 and the gears 34.

The drive or support frame system 35 is generally of rectangular outline. Its one longitudinal side 36 is extended by its narrow sides 37 and 38 and, respectively, forms the guide elements 39 and 40. The two guide elements 39 and 40 are formed identically and extend at right angles to the longitudinal side 36 of the support system 35.

The two guide elements 39 and 40 rest on pertaining guides 41 and 42 (FIG. 2) which are arranged on the inner wall of the oppositely provided walls 17 and 32 of housing 1 in the longitudinal direction thereof. For the formation of the guides 41 and 42, cross members 43 are positioned in parallel and at a distance to housing wall 23, on the inner wall surfaces of the bordering housing walls 17 and 32. Within the two oppositely positioned (FIG. 2) guides 41 and 42 there are arranged the two legs 44 of a generally U-shaped set part 45, the legs 44 of which are joined at the pertaining ends facing the side face 3 of housing 1 by a transverse member 46. The transverse member 46 is supported on the inner wall surface of housing wall 23. The two legs 44 of the set part 45 are entirely within the guides 41 and 42 provided by the cross member 43 and the opposite housing wall 23. In the region of the guide elements 39 and 40 of the support system 35, the legs 44 are slotted, while the guide elements 39 and 40 of the support system 35 which are resting on the cross member 43, engage with a boss 47 (FIG. 2) the slot of the legs 44 and are, thus, guided in the guides 41 and 42.

Figure 6:
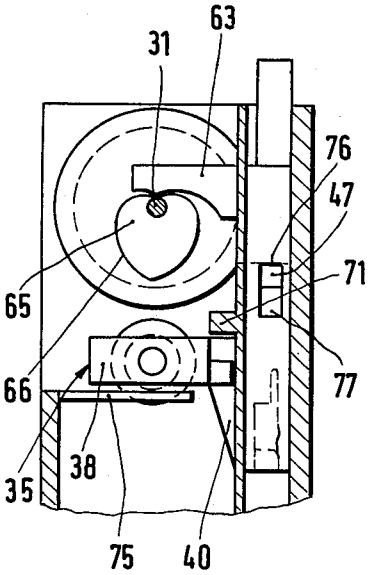
FIG. 6 is a representation according to FIG. 5 indicating a reset position of the reset system.
Figure 7:
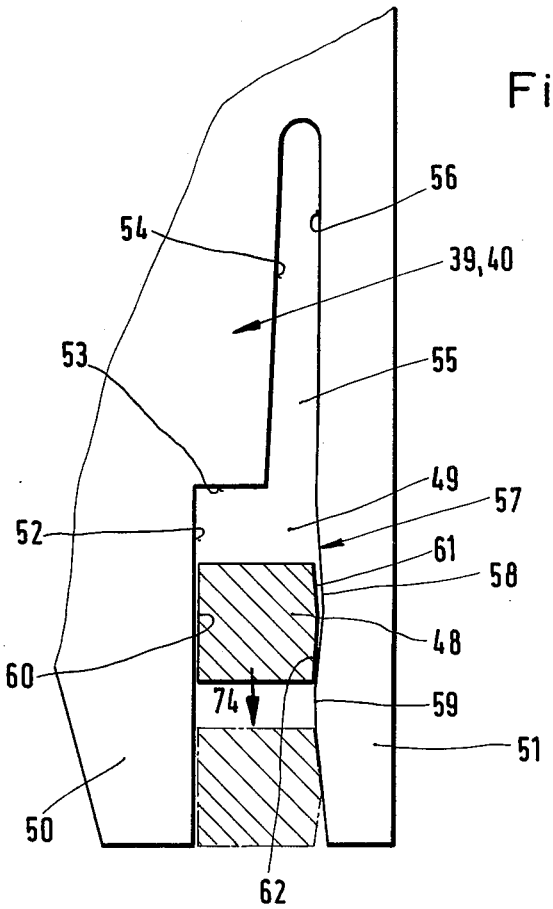
FIG. 7 is a representation of the section VII—VII in FIG. 5.

The set part 45, forming part of the reset system for the indicator wheels 30, in turn, extends with a protrusion 48 (FIG. 5, FIG. 7) in a slot 49 provided in pertaining guide elements 39 and 40. As is more clearly indicated in FIG. 7, slot 49 is defined by two legs 50 and 51 of respective guide elements 39 and 40. The inner surface 52 of leg 50, facing leg 51, is planar and extends parallel to cross member 43 (FIGS. 5 to 7). The inner surface 52 merges with a rectangular step 53 in the planar inner surface 54 of a slot 55, which slot 55 is substantially narrower than slot 49 (FIG. 7). The other inner surface 56 of slot 55 extends generally parallel to inner surface 54 and merges with the inner surface 57, which limits the slot 49 of leg 51. The two inner surfaces 56 and 57 of leg 51 extend, approximately, in a common plane. The inner surface 57, however, comprises, in the region adjacent the inner surface 56, a V-shaped depression 58 which immediately changes into a V-shaped raised portion 59, as shown in FIG. 7. The protrusion 48 of set part 45 lies with its planar outer side 60 on the planar inner surface 52 of the guide element leg 50, with its entire surface. The opposite outer side of protrusion 48 is formed by two planar sections 61 and 62 which extend at an obtuse angle having its apex at central height of the protrustion 48. The inclination of the two sections 61 and 62 is selected so that the protrusion 48, in the upper position indicated in FIG. 7, rests, surficially, with its section 62 on the one inclined surface of depression 58 or, respectively, on the raised portion 59 of the inner surface 57 of guide element leg 51. When the set part 45 is moved, for resetting of the indicator wheels 30, into the housing 1, the protrusion 48 shifts to the position indicated in FIG. 7 in dash-dot outline, in which position the protrusion 48 then rests with its entire surface of the other outer surface section 61 on the other inclined surface of raised portion 59 of inner surface 57. The inclined surface of raised portion 59 extends to the free end of the guide element leg 51.

On the transverse member 46 of the set part 45 there are provided arms 63 which extend at right angles into the housing interior. The arms 63 are preferably unitary with the set part 45. The number of arms 63 corresponds to the number of indicator wheels 30. In the plan view according to FIG. 8, it is indicated that the free ends of the arms 63 are at a distance away from longitudinal side 64 of drive system 35. The drive system extends normal to the side walls 17 and 32 of housing 1. The arms 63 are identical and are positioned adjacent the side of pertaining indicator wheels which is opposite to the side carrying the gear 29 (FIG. 2). In the region below each arm 63, each indicator wheel 30 has on the side facing the gear 29, a control cam 65, generally heart-shaped (FIG. 5), eccentrically provided on axle 31. A depression 67 is provided in cam contour 66 near axle 31.

The under side of each arm 63 of the set part 45 directed towards the control cam 65 is generally continuously curvilinear and, only, near its free end provided, with a protrusion 68 which engages, in reset position of the set part 45, in the depression 66 of a pertaining control cam 65 (FIG. 6).

In operation, the terminals 8 and 8' of the pulse counter are connected to electrical conductor or lead wires. In the event of a pulse, the spool and coil means 6,7 is excited and the resultant magnetic field attracts the armature anchor 21. This causes movement of the armature anchor in the recess or bearing 22 of housing wall 23 from the position indicated in FIG. 3 in solid lines to the position indicated in dash lines. Due to movement of the armature anchor, the escapement anchor 25 is swung about the pivot center provided by axle 26 into actuating position, but against the force of a spring 69, and rotates, thereby, the gear 28 for a distance corresponding to one tooth of the gear. The spring 69 may be a compression spring, a tension spring or a lever spring or spring clip. Preferably, the spring 69 is a lever spring or leaf clip which is provided on axle 26 and which presses against the escapement anchor 25 in the direction of its pertaining start position. When using a lever spring or spring clip, the spring 69 can be space-savingly arranged within the housing 1.

The gear 28 is in meashing engagement with a further gear, not shown, provided on axle 33 which gear, not shown, is also meshingly engaged by the gear 29 of the indicator wheel 30 adjacent the escapement anchor 25. Turning of the gear 29, thus, causes stepwise turning of the pertaining indicator wheel 30. The other indicator wheels 30 are not driven and will be held in their respective positions by the pertaining gears 34 which meshingly engage with the gears 29 provided for the indicator wheels 30. With each stepwise turning, there will appear in the viewing window, not shown, successively one of the digits 0 to 9. When the indicator wheel 30 adjacent the escapement anchor 25 has made a complete revolution, two projections, not shown, come into contact with a tooth 34 on further axle 33, the two projections, not shown, extending axially forwardly at the circumference of the indicator wheel 30 on the side facing the control cam 65. On coming into contact of the projections, the pertaining gear 34 is turned through an arc corresponding to one tooth. The pertaining indicator wheel 30, by the intervention of its gear 29 with the gear 34, is thereby moved through a further counting step. In the same manner, also, the other indicator wheels 30 revolve about axle 31. Upon each complete revolution of indicator wheel 30 the two axial projections of the indicator wheel come into contact with the pertaining gear 34 and move this by one counting step, the gear 34, in turn, by meshing engagement with gear 29, further turning the indicator wheel in stepwise manner. Correspondingly, the number of counted pulses is shown in the viewing window, not shown, of the housing 1. The "on" position or switch position of the pulse counter is represented in FIG. 5 in which gear 34 on axle 33 meshingly engages the gear 29 of the indicator wheel 30.

In this "on" position, the set part 45 is in the commencement position, as is indicated in FIGS. 2 and 5. In the direction of this commencement position, the set part 45 is under pressure by a compression spring 70 (FIG. 2) which exerts pressure on the transverse member 46 with one end, the other end of the spring being secured in the housing. The protrusion 48 of the set part 45 assumes, then, the position shown in solid lines in FIG. 7, in which the protrusion 48 is in contact, by means of its outer surface section 62, with that side surface forming an inclined surface of the raised portion 59 adjacent depression 58 in the inner leg surface 57. The end position of the drive system 35 is provided by an abutment 71 (FIG. 5), which is provided on the pertaining face surface of the cross members 43 facing away from housing wall 23. The two guide elements 39 and 40 of the drive system are, in the commencement position, in contact with a pertaining ledge 72 with the abutment 71 (FIG. 5).

In this commencement position, the indicator wheels 30 can be reset, in which reset position, normally, all indicator wheels will show "0" in the viewing window. For this, the set part 45 is moved into the housing 1 by means of handle 73 extending out of housing 1. The two legs 44 of set part 45 are then moved within guides 41 and 42 in the direction of the spool and coil means 6,7. The protrusions 48 of the two legs 44 are in contact through their outer surface sections 62 with pertaining inclined surfaces of the depression 58 in inner surface 57 provided in guide element leg 51. Due to the decrease in width, decreasing in the direction of movement as indicated by arrow 74 (FIG. 7), of the slot 49 in pertaining guide elements 39 and 40, there is provided a frictional contact between the protrusion 48 and the pertaining guide element of the drive system 35 so that the drive system, on movement of the set part 45, is also moved in the direction indicated by arrow 74. The guide element 39,40 glides with its boss 47 in the slot of a pertaining set part leg 44. On shifting of the drive system 35, the axle 33 and the gears 34 provided thereon are also moved in the direction indicated by arrow 74, so that the gears 34 are disengaged from the gears 29 of pertaining indicator wheels 30. The gears 34 then move against a pertaining, housing-fast ledge 75, reaching into the housing interior, which ledge 75 limits the downward movement of the drive system 75. The set part 45 is now further moved in the direction of arrow 74 whereby the protrusions, with simultaneous release of the frictional contact, are shifted in the slot 49 of the guide elements 39, 40 of the drive system 35. The protrusions 48, thereby, must be moved over the raised portion 59 provided in leg 51, whereby the leg 51 is elastically deformed. Finally, the protrusion 48 reaches the end position indicated in dot-dash lines in FIG. 7. In this position protrusion 48 engages with its other outer surface section 61 the inclined surface of raised portion 59 extending to the free end of leg 51. The elastic deformation of leg 51 is simplified thereby that the slot 49 merges or extends into the narrower slot 55. Leg 51 can be strongly resiliently formed, so that an accurate frictional contact between the leg 51 and protrusion 48 is ensured in commencement position and in end position of the set part 45. The end position of the set part is determined by the boss 47 of the guide element 39, 40, which is then in contact with the endwise edge 76 of aperture 77 in the leg 44.

When the drive system 35 has reached its end position in accordance with FIG. 6, the arms 63 of the set part 45 move with pertaining protrusions 68 onto the contour surface 66 of a pertaining control cam 65 associated with a pertaining indicator wheel 30. Since the drive system 35 is in its end position, the gears 34 are disengaged from gears 29 of pertaining indicator wheels 30. The indicator wheels 30 are then free to revolve about axle 31. When the arms 63 move, with their projections, onto the contour surface 66 of the control cam 65, the indicator wheels 30 are moved through such an arc, due to the heart-shaped contour surface 66, on further movement of the set part 45, until the projection 68 rests in the depression 67 of the contour surface 66 of the pertaining control cam 65 (FIG. 6). The position of the depression 67 in the contour surface 66 of a control cam is selected so that in the viewing window of the housing, then, the digit desired for the commencement position, usually the digit "0", can be seen, when the projection 68 is in the depression 67. In this manner, all indicator wheels 30 are brought to their commencement position by the arms 63. On release thereof, the set part 45 is moved out of housing 1 by the compression spring, in the direction opposite to that indicated by arrow 74 (FIG. 7). The two guide elements 39 and 40 of the drive system 35 are carried along by the protrusion 48 of the legs 44, due to frictional contact. As indicated in FIG. 7, the protrusions 48 of the legs 44 are positioned behind the raised portion 59 of the leg 51, in opposite direction to that indicated by arrow 74, so that a relative movement between the drive system 35 and the set part 45 is prevented. The gears 34 of the drive system 35 now come, again, into meshing engagement with the gears 29 of pertaining indicator wheels 30, and the ledges 72 of the drive system 35 come to rest, again, at the abutment 71 (FIG. 5) in housing 1. At the same time that the drive system 35 is moved, also the arms 63 of the set part 45 are moved, but in the opposite direction to that indicated by arrow 74 and are, thus, lifted from the control cam 65. When the drive system 35 has reached its commencement position again, as determined by the abutments 71, the set part 45 is further moved out of the housing 1 due to the action of the compression spring 70. The pressure of the compression spring 70 is sufficient to remove the frictional contact between the guide elements 39 and 40 of the drive system 35 and the protrusion 48 of the leg 44. The protrusion 48 is moved in the slot 49 of guide elements 39, 40 in the direction opposite to that indicated by arrow 74, whereby the leg 51, due to raised portion 59, is elastically bent outwardly, so that the protrusion 48 can be moved past raised portion 59. Subsequently, the leg 51 returns to its original position. The upper end position of set part 45 is attained when the leading edge 78, in the direction of arrow 74, of the aperture 77 in leg 44 rests on the boss 47 of the pertaining guide element 39, 40 of the drive system 35 (FIG. 5).

In the pulse counter according to the invention, the frictional contact is directly attained between the drive system 35 and the set part 45. Accordingly, no intermediate components such as, for example, springs, are required. This eliminates additional, cost-increasing structural components, and the assembly of the pulse counter is substantially simplified. Instead of the described formation of inner surface 57 of leg 51, this inner surface could be planar and, for example, extend parallel to the inner surface 52 of the opposite leg 50 of the guide element. Again, an accurate frictional contact can be directly attained between the drive system and the set part. A further advantage of the impulse counter in accordance with the invention is provided therein that the guides 41 and 42 for the set part 45 and the drive system 35 are directly provided by housing 1. For assembly, only the set part 45 is to be inserted into guides 41 and 42 and, subsequently, the drive system 35 is installed. No modification of the housing is required. Also, the ledges 75 which form the abutments for the drive system 75 are unitary with the housing.

Figure 9:
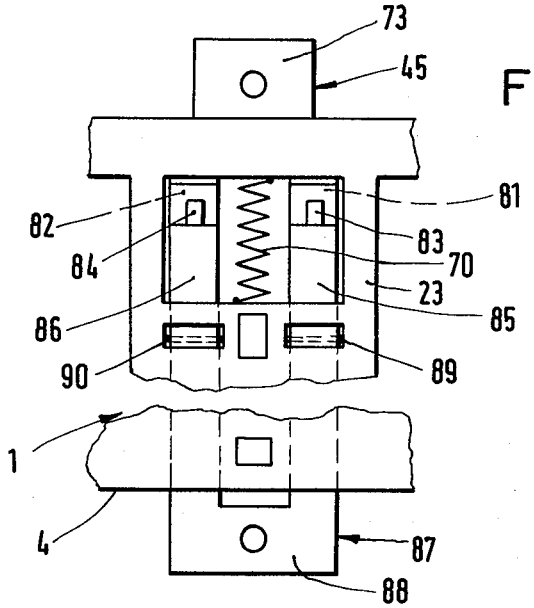
FIG. 9 indicates part of the rearward side of the pulse counter in accordance with the invention with the housing cover removed.

The iron core 13 is directly held with its projection 15 in housing 1 where also the armature anchor 21 is movably held. By this arrangement, the two end faces 79 and 80 of the two extensions 12 and 14 are in a common plane and form one limit of the air gap 20. During operation of the pulse counter, temperature fluctuations cannot be avoided, so that the housing 1 expands or contracts. The thermal expansion of housing 1 has no effect on the size of the air gap, since the iron core 13 is held with projection 15 in housing 1, as is the armature anchor 21, while the spool body 6, with windings 7, is provided with a clearance on the iron core. When the housing expands or contracts, the iron core 13 and the magnetic anchor 21 follow such movements at the same rate, so that the size of the air gap 20 is maintained substantially constant. Accordingly, the air gap 20 can be adjusted to a size which is adequate for a low current consumption. Tolerances or permissible limits with respect to the thermal expansion of the housing of the spool body 6 do not have to be considered. Furthermore, a simple installation of the iron core and the spool body 6 is feasible, due to the projection 15. Opening 16 in housing wall 17 determines the installed position of the iron core 13, and, together with the recess 22 in the housing 23, determines the size of the air gap 20. Since complicated and elaborate calibration or adjustment work for adjusting of the air gap 20 are eliminated, assembly of the pulse counter can be carried out by untrained labor. Advantageously, the resetting of the indicator wheels 30 can also be carried out on the side of the housing 1 which is opposite to that of handle 73. For this purpose, the transverse member 46 of the set part 45 has two spaced-apart lugs 81 and 82 (FIG. 9) which comprise, on pertaining sides directed toward housing side 23, detent projections 83 and 84. The detent projections 83 and 84 engage in recesses of a pertaining leg 85 and 86 of the U-shaped extension piece 87, extending beyond the lower edge of carrier 4 at housing 1. The cross member 88, extending outside of the housing 1, of the extension piece 87, serves as a handle to reset the set part 45, against the force of compression spring 70, to the reset position. The two legs 85 and 86 of the extension provided 87 are, advantageously, guided in depressions, not shown, provided in the inner surface of rear wall 23 of housing 1. Furthermore, the legs 85 and 86 are guided by a pertaining holder 89, 90, which is preferably unitary with the housing rear wall 23.

The pulse counter in accordance with the invention serves for counting of pieces and for the determination of time. When used as piece counter, it can be used in industry, particularly in tool machinery and installations in which the number of pieces is to be determined. When the time is to be determined, the counter can be used in all industries, and for counting of seconds, minutes, and hours, that is, for example, for recording presence and absence time periods. In such an application the pulse counter, for example, receives second or minute pulses.

The present invention is, by no means, limited to the specific showing in the drawings, but also encompasses any modifications within the scope of the appended claims.

What is claimed is:

1. An electromechanical pulse counter, comprising, in combination:

a walled counter housing;

an iron core having first and second arms, said first arm being positively securable in a pertaining wall of said housing;

spool and coil means operatively secured in said housing for the provision of a magnetic field, said spool and coil means surrounding said second arm of said iron core; whereby said second arm is movably disposed within said spool and coil means;

an armature mounted near said pertaining wall holding said first arm, said armature being responsive to a magnetic field provided by said spool and coil means;

said armature and said core being spaced from one another so as to form an air gap;

an escapement anchor mounted in said housing actuable in response to movement of said armature, said escapement anchor including at least a fork member;

at least one rotatable indicator wheel mounted in said housing, said indicator wheel having circumferentially disposed count indicative insignia and being stepwise rotatable in response to actuation of said escapement anchor;

gear drive means operatively connectible between said fork member and said at least one indicator wheel for rotation of a pertaining indicator wheel, said gear drive means including at least one gear actuable by said fork member of said escapement anchor, said armature including a plate-like armature anchor, said housing including an opening in the pertaining wall and wherein said iron core includes a projection securably mountable in said opening.

2. An electromechanical pulse counter in accordance with claim 1, wherein said iron core includes a U-shaped iron core having a connecting base member, said second arm surrounded by said spool and coil means and said first arm including said projection for said positive securement of said iron core in said housing.

3. An electromechanical pulse counter in accordance with claim 2, and further including:

a carrier for supporting said spool and coil means in said housing, said carrier having a depression; wherein said connecting base member is at least in part longitudinally retained in said depression.

4. An electromechanical pulse counter according to claim 2, wherein pertaining end faces of said first and second arms of said iron core extend in a common plane.

5. An electromechanically operable pulse counter, comprising, in combination:

a walled counter housing;

an iron core having first and second arms, said first arm being positively securable in a pertaining wall of said housing;

spool and coil means operatively secured in said housing for the provision of a magnetic field, said spool and coil means surrounding said second arm of said iron core; whereby said second arm is movably disposed within said spool and coil means;

an armature mounted near said pertaining wall holding said first arm, said armature being responsive to a magnetic field provided by said spool and coil means;

said armature and said core being spaced from one another so as to form an air gap;

an escapement anchor mounted in said housing actuable in response to movement of said armature, said escapement anchor including at least a fork member;

at least one rotatable indicator wheel mounted in said housing, said indicator wheel having circumferentially disposed count indicative insignia and being stepwise rotatable in response to actuation of said escapement anchor; and gear drive means operatively connectible between said fork member and said at least one indicator wheel for rotation of a pertaining indicator wheel, said gear drive means including at least one gear actuable by said fork member of said escapement anchor, at least two indicator wheels movably mountable in said housing;

shaft means for mounting said at least two indicator wheels in said housing;

a support frame system;

shaft means for mounting pertaining gears of said gear drive means in said support frame system;

a set part for resetting of said at least two indicator wheels to a commencement position in which a pertaining indicator wheel is disengaged from a pertaining gear; and guide means provided in said housing for movably guiding therein said support frame system, whereby said support frame system is directly frictionally connectible to said set part, and whereby said set part is disposed in said guide means and movable with respect to said support frame system on elimination of said frictional connection for resulting of said at least two indicator wheels to pertaining commencement positions.

6. A pulse counter according to claim 5, wherein said set part includes at least one protrusion engageable with a slot in said support frame system, wherein said protrusion is in frictional contact at pertaining lateral walls of said slot.

7. A pulse counter according to claim 6, wherein at least one of said lateral walls of said slot includes a raised portion which reduces the width of said slot, said raised portion being located between two end positions of said protrusion of said set part relative to said support frame systems.

8. A pulse counter according to claim 7, wherein said slot is defined by two legs, one of said legs comprising said raised portion and being resilient.

9. A pulse counter according to claim 8, wherein said set part includes a generally U-shaped set part having first and second legs, said legs being shiftably guided by said guide means.

10. A pulse counter in accordance with claim 9, wherein each of said first and second legs includes a protrusion.

11. A pulse counter according to claim 10, wherein the support frame system includes a substantially frame-like support frame for carrying said gear drive means, said support frame including at least two plate-like guide elements, longitudinally shiftable in said guide means.

12. A pulse counter according to claim 11, wherein at least one of said plate-like guide elements includes a boss shiftable in said guide means interiorally of said housing.

13. A pulse counter according to claim 12, wherein each of said plate-like guide elements includes a boss, and wherein each of said guide means includes an aperture, whereby said bosses are operatively connectible in said aperatures.

14. A pulse counter according to claim 13, wherein the shifting distance of said support frame system is limited in both directions of movement by at least one ledge secured in said housing.

15. A pulse counter according to claim 14, wherein said guide means are formed in part by a pertaining house wall and a pertaining cross-member within said housing, extending parallel to said wall.

16. A pulse counter according to claim 15, wherein said first and second legs of said set part have the same width as said guide means.

17. A pulse counter according to claim 16, wherein said set part includes a handle extending externally of said housing, and further including an extension piece coacting with said set part, said extension piece extending out of said housing at a housing side other than said handle.

18. A pulse counter according to claim 17, wherein said extension piece is releasably connectible to said set part.

* * * * *